United States Patent [19]

Tibussek

[11] Patent Number: 4,750,770

[45] Date of Patent: Jun. 14, 1988

[54] DEVICE FOR CONNECTING A DRILL COLUMN TO A PIPE OR THE LIKE

[75] Inventor: Fritz Tibussek, Monchen-Gladbach, Fed. Rep. of Germany

[73] Assignee: Wirth Maschinen-und Bohrgerate-Fabrik, Erkelenz, Fed. Rep. of Germany

[21] Appl. No.: 887,094

[22] PCT Filed: Oct. 28, 1985

[86] PCT No.: PCT/DE85/00427

§ 371 Date: Jun. 30, 1986

§ 102(e) Date: Jun. 30, 1986

[87] PCT Pub. No.: WO86/02695

PCT Pub. Date: May 9, 1986

[30] Foreign Application Priority Data

Oct. 30, 1984 [DE] Fed. Rep. of Germany ..... 3439653

[51] Int. Cl.[4] ..... E21B 31/20

[52] U.S. Cl. ..... 294/86.15; 166/212; 294/86.24; 294/93

[58] Field of Search ..... 294/86.1, 86.15, 86.17, 294/86.19, 86.24, 86.25, 90, 93–95, 97; 166/98, 120, 125, 131, 187, 212

[56] References Cited

U.S. PATENT DOCUMENTS

| | | | |
|---|---|---|---|
| 2,481,637 | 9/1949 | Yancey | 294/86.24 X |
| 2,606,002 | 8/1952 | Larson | 166/250 |
| 2,935,615 | 5/1960 | True | 166/187 X |
| 3,350,130 | 10/1967 | Ahlstone et al. | 294/86.25 |
| 3,503,445 | 3/1970 | Cochrum et al. | 166/187 X |
| 3,901,546 | 8/1975 | Piazza et al. | 294/86.25 X |
| 3,961,673 | 6/1976 | Wolters et al. | 175/52 |
| 4,050,731 | 9/1977 | Coone et al. | 294/86.24 |
| 4,133,386 | 1/1979 | Knox | 166/212 X |

FOREIGN PATENT DOCUMENTS 1106987 9/1953 France .

*Primary Examiner*—Johnny D. Cherry
*Attorney, Agent, or Firm*—Holman & Stern

[57] ABSTRACT

An actuating system for operating pressure-medium actuated coupling members for remotely connecting a drill column to a pipe or pipe casing, where the location of the connection is inaccessible, comprises a directional control valve (48) switchable by an actuator (46) and having at least three connections (51, 52, 53), a coupling (47) operated in one direction by the actuator disposed between the actuator (46) and the adjustable part of the directional valve (48). The coupling members may be a plurality of radially movable bearing members (34) and bars (24) spaced apart in the axial direction of the device.

19 Claims, 5 Drawing Sheets

DEVICE FOR CONNECTING A DRILL COLUMN TO A PIPE OR THE LIKE

BACKGROUND OF THE INVENTION

1. Field of the Invention

The invention relates to a device, i.e. a unit for incorporation in a drill column for releasably connecting the drill column to a pipe or similar hollow member, comprising coupling members for attaching to the pipe and associated with piston-cylinder units having pistons adapted to be supplied at one end with a pressure medium for moving the coupling members to a different operating position and being spring-loaded at the other end for moving the coupling members back.

2. Description of the Prior Art

In drilling technology it may be necessary for a pipe or "casing" to be entrained downwards by a drill column, which usually comprises a number of parts and ends at the bottom in a drilling head or the like, without it being necessary or possible to use a special pipe-holder or releasing device. This happens inter alia when the drill column is relatively long and a casing, tubular shell, borehole lining or the like is needed only at the bottom of the drill column, i.e. mainly in boreholes under water in the offshore area, e.g. in the case of bored pipes and the like.

A unit comprising coupling members in the form of radially movable bolts can be incorporated in the drill column at the place which is intended to be near the top end of the entrained pipe or casing. The coupling members engage in holes in the pipe and can be held in position by hydraulic pressure. During drilling, they transmit rotation and axial motion from the drill column to the pipe. When the pipe has reached the desired depth during drilling, e.g. when it has reached hard ground after boring through an unstable area, the pipe has to be detached from the column. To this end, the retaining pressure on the bolts is relieved by a cable extending along the drill column from above ground, so that the bolts move radially inwards under spring pressure and come out of the openings in the pipe. The column can then be used for further drilling, whereas the pipe remains in position. A connection of this kind between a drill column and a pipe must be made above ground, since otherwise the bolts cannot go into the openings in the pipe. Also, it is impossible to couple the drill column to the pipe subsequently, as is desirable in certain cases.

BRIEF SUMMARY OF THE INVENTION

The object of the invention is to produce a device for coupling a drill column to a pipe or the like, which enables the column to be repeatedly connected to a pipe, casing or the like and the connection to be made even without direct access to the place of connection, more particularly under water. The invention also aims at a particularly advantageous construction, for practical requirements, of a device for releasably connecting a drill column to a pipe or the like. Other associated problems covered by the invention will be clear from the following description of the disclosed solution.

The invention is characterized by an actuating system for the piston-cylinder units supplied by a single pressure-medium line from a pressure-medium source above ground, the actuating system comprising a directional control valve switchable by a pressure-medium actuator and having at least three connections, of which a first is connected to a pressure-medium supply line, a second is connected to at least some of the cylinder-piston units and a third is connected to an outlet line, the pressure-medium actuator being connected to the supply line and a coupling, ratchet or the like active in one direction is provided between the actuator and the adjustable part of the directional control valve.

The device can be used for coupling the drill column, releasing the coupling and making a new connection when desired. This is done in simple manner by building up or releasing the pressure in a single pressure-medium line.

Advantageously the actuator is a piston-cylinder unit with a return spring which can be incorporated in the unit or associated with a connected part.

A pressurizing valve is advantageously disposed in the line leading to the first connection of the directional control valve, thus ensuring a particularly advantageous time sequence of operations in the system.

In another embodiment of the device, an openable non-return valve is provided in the line leading from the second connection of the directional control valve to the piston-cylinder units and the control line of the non-return valve is connected to a fourth connection of the directional control valve. This ensures particularly reliable operation of the device.

The pressure-medium line leading to the actuating system can have any suitable shape, and can also be a line leading along the column. It is particularly advantageous for the pressure-medium line to be a central cavity in the drill column, i.e. through the interior of the component pipes. Depending on the functions to be performed by the drill column in association with a tool or other unit, it may be advantageous to provide a seat in a central cavity of the device for a sealing piston lowerable into the drilling column by a cable. After the device has been used in a coupling or uncoupling process, the piston is pulled out again, leaving a continuous open passage in the drill column for other purposes, more particulary for flush cleaning.

There are various possible methods of constructing the coupling members. An advantageous embodiment is characterized by coupling members each movable against the force of a spring relative to the pistons of the piston-cylinder units, the coupling members each having a slope at its front end. The device, when incorporated in a drill column, can then be lowered over the end of a pipe, whereupon the coupling members are pressed back irrespective of the position of the piston in contact with the edge of the pipe, and thereafter remain against the pipe inner wall until they can take up the desired position, i.e. enter openings in the pipe or the like to be coupled or extend under or over a surface on the pipe.

Irrespective of the rest of the construction, the coupling members can be bolts, bars or the like or alternatively can be toggle levers. The cylinder-piston units for actuating the levers may more particularly be disposed parallel to the longitudinal axis of the device.

The coupling members can be disposed and constructed so as to transmit a downward and/or upward force from the drill column to the pipe. Depending on requirements, therefore, only coupling members transmitting force in one direction may be provided. Alternatively, there may be two groups of coupling members, one transmitting force downwards and the other transmitting force upwards.

More particularly the coupling members can be in the form of bearing members having a bearing surface adapted to be brought against a surface on the pipe or the like. All the coupling members may be bearing members of the aforementioned kind, e.g. if only an axial force, not a torque, has to be transmitted from the drill column to the pipe.

In an alternative construction, depending on requirements, the coupling members are a number of bearing members and bars spaced apart in the axial direction of the device. The only purpose then served by the bearing members will be to bring the bars level with the openings in the pipe when the drill column is lowered relative to the pipe. The bearing members will then act as abutments. Alternatively they can exert pressure on the pipe from below. More particularly the bars can transmit mainly torque and the bearing members can transmit mainly axial force from the drill column to the pipe.

In another embodiment, the top edge of the pipe to be coupled has recesses for bringing into engagement with coupling members. This provides an advantageous connection since the coupling members can easily enter the recesses, and also enables torque to be transmitted when required.

If the pipe to be coupled must not be rotated but only axially entrained by a drill column which rotates during operation, advantageously, an internal member connectable to parts of the drill column is rotatably mounted in a housing containing the coupling members.

BRIEF DESCRIPTION OF THE DRAWINGS

Other details, features and advantages of the invention will be clear from the following detailed description of embodiments with reference to the accompanying drawings wherein.

DETAILED DESCRIPTION

Figure 1:
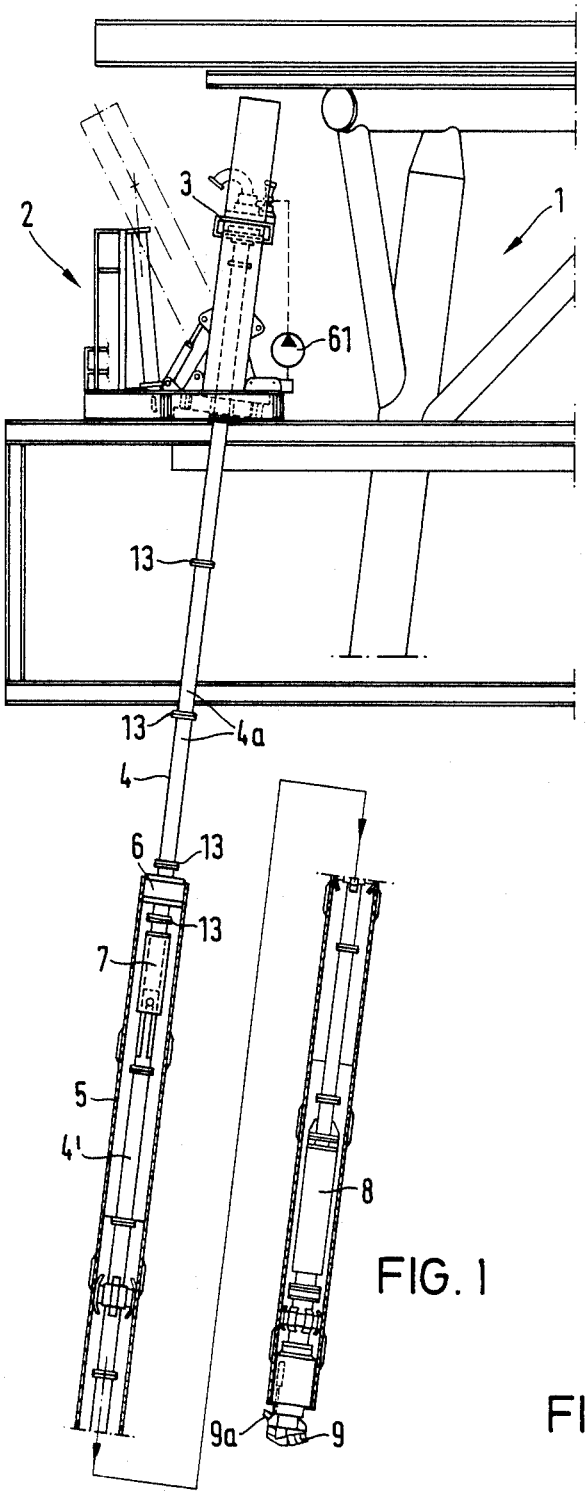
FIG. 1 is an elevational and part cross-sectional view of part of a platform with drilling equipment and a drill column showing one possible application of the device of the invention.

FIG. 1 shows part of a platform 1, e.g. in offshore use, containing drilling equipment 2 suitable for the air-lift drilling process and comprising a power-driven rotary head 3. Reference 4 denotes a drill column made up of a number of tubular parts 4*a* and reference 5 denotes a pipe or casing temporarily entrained by the column. The column contains a device 6 for coupling column 4 to pipe 5. The column parts 4*a* are releasably connected to one another and to device 6 by flanges 13.

In the embodiment in FIG. 1, the drill-column part 4' comprises a known telescopic device 7, a drill stem 8 and a drilling tool 9 in the form of a drilling head having undercutters, eccentric tools 9*a* or the like which are radially extendable over the diameter of the drilling head.

Figure 2:
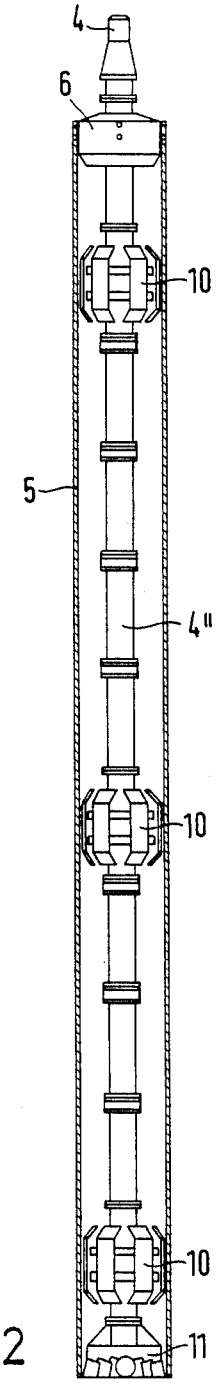
FIG. 2 is a longitudinal cross-sectional view of another embodiment of a drill column and a pipe to be coupled in accordance with the invention.

FIG. 2 shows another embodiment of a drill-column part 4'' underneath and adjacent the device 6 and comprising a number of stabilizers 10 or the like and a drilling head 11 without an eccentric bit. As in other parts of the description, reference 5 here denotes a pipe or casing to be entrained.

Figure 3:
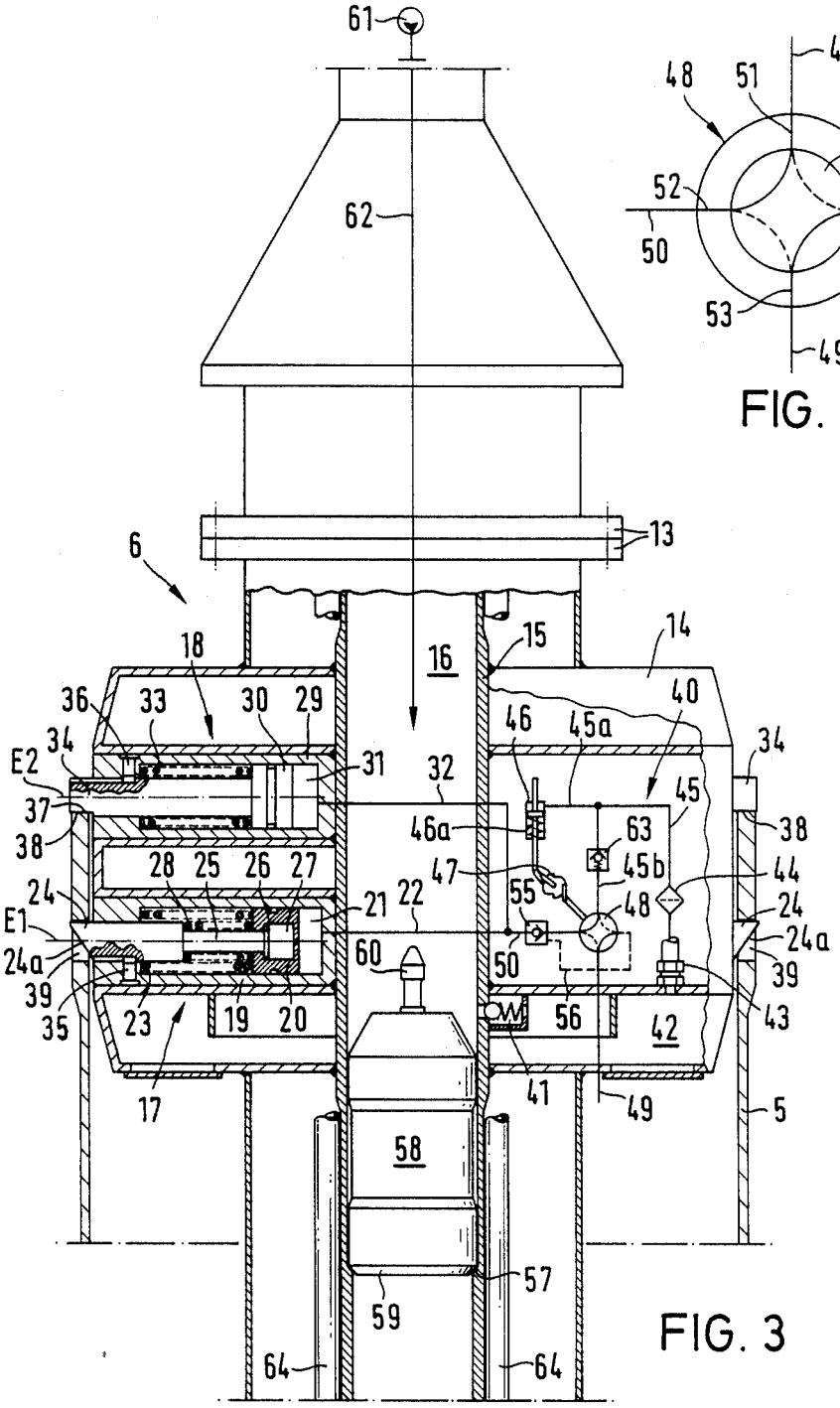
FIG. 3 is a cross-sectional and partly diagrammatic view of an embodiment of the device in detail.

FIG. 3 shows an embodiment of a device comprising a casing 14 containing an inner pipe 15 with a free internal passage 16. Pipe 15 is a continuation of the individual tubular parts 4*a* (FIG. 1) of the drill column 4. Casing 14 contains piston-cylinder units 17, 18 in two different planes or levels E1 and E2. Units 17, 18 are distributed around the periphery at equal angular intervals. There can be e.g. four or more units. Each unit 17 contains a cylinder 19 and a piston 20. The cylinder chamber 21 can be supplied with pressure medium via a diagrammatically-indicated line 22. Piston 20 is loaded by a compression spring 23 which resiliently urges it radially inwards. Reference 24 denotes a coupling member in the form of a bar having a shank 25 and a thickened end part 26 extending into an evacuated cavity 27 in piston 20. A compression spring 28 is disposed between piston 20 and a shoulder on bar 24 and resiliently pushes the bar away from piston 20. Bar 24 can be pushed against the force of spring 28 radially relative to piston 20, i.e. into the piston. The front end of bar 24 has a bevelled or sloping end face 24*a*.

Unit 18 likewise comprises a cylinder 29 containing a movable piston 30 permanently connected to a bearing member 34. The cylinder chamber 31 can be supplied with pressure medium via a line 32 parallel to line 22. Piston 30 is loaded by a compression spring 33 which resiliently pushes it radially inwards. References 35 and 36 denote guide bolts engaging respectively in grooves in bars 24 or members 34 and likewise preventing parts 24 and 34 from rotating around their longitudinal axes. The front end of each bearing member 34 has a bottom bearing surface 37 which can abut the top end face 38 of pipe 5.

Pipe 5 is formed with radial openings 39, the number and spacing between the openings being such that bars 24 can enter them.

Figure 4:
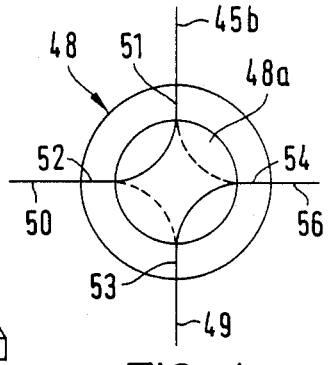
FIG. 4 is a diagram of a valve.

Reference 40 denotes an actuating system for the piston-cylinder units 17 and 18. A non-return valve 41 is provided in an opening in the wall of pipe 15 so that pressure medium, more particularly water, supplied through the interior 16 of pipe 15 can flow into a closed chamber 42 and thence through a connection 43 into a supply line 45 containing a filter 44. Line 45 branches as diagrammatically shown, one branch 45*a* leading to a pressure-medium actuator 46 constructed as a piston-cylinder unit, the side of the piston remote from the pressure-medium chamber being loaded by a return spring 46*a*. Drive 46 is used for switching the adjustable part 48*a* of a directional control valve 48 via a coupling or additional switching device 47 active in only one direction and constructed e.g. on the ratchet principle. The valve, shown only diagrammatically in FIGS. 3 and 4, is advantageously a 4/2-way valve having four connections 51, 52, 53 and 54, connection 51 being connected to a branch 45*b* of supply line 45 and connection 53 being connected to an outlet line 49 which can open e.g. into the annular space between device 6 or column 4 and pipe 5. Connection 52 is connected to a line 50 containing an openable non-return valve 55 whose control line 56 is connected to the fourth connection 54 of valve 48. Behind valve 55, line 50 branches into two portions 22, 32 leading to units 17, 18, respectively.

A sealing seat 57 in the inner pipe 15 of device 6 is provided for a sealing piston 58, the bottom end of which has a sealing surface 59 fitting the seat 57. At the top end of the piston there is a coupling cone 60 for a known gripping device, so that piston 58 can be lowered through the drill column by a cable from above ground and can also be pulled out of the column. In the drawings, reference 61 diagrammatically indicates a pressure-medium source, more particularly a pump, and reference 62 denotes a line portion formed by the free internal space in the parts 4*a* of the drill column. By means of piston 58, the line portion in the drill column can be used to operate device 6, whereas at other times it is available or can be used for other purposes, e.g. for flush cleaning or for the air-lift drilling process.

When piston 58 has been lowered into the drill column and device 6 is above the end of a pipe 5 to be coupled to the column, the above-ground pump 61 can be switched on so that pressure medium, more particularly water, is conveyed downwards through the drill column, the rest of which is closed, and flows from the inner chamber 16 through valve 41, chamber 42, connection 43 and filter 44 into line 45 and continuation 45*a* thereof.

When the pressure in the line portion has risen to a preset amount, e.g. 10 bars, actuator 46 is brought into operation, its piston reaching the limit position at e.g. 15 bars. As a result, valve 48 is actuated by ratchet 47 so as to connect connections 51, 52 and 53, 54 as shown by continuous lines in FIGS. 3 and 4. The pressure in the column and connected line portions continues to rise and, at a set value of e.g. 20 bars, opens a pressurizing valve 63 disposed in the other branch 45*b* of supply line 45. The supplied pressure medium can then flow via valve 48, line 50, non-return valve 55 and branch lines 22, 32 to the piston-cylinder units 17 and 18, thus pushing out their pistons 20, 30 and consequently pushing out bars 24 and bearing members 34. Pump 61 is then switched off. The resulting pressure drop closes the non-return valve 55, and the piston of actuator 46 is returned to its starting position by the force of spring 46*a*.

The previously-mentioned gripping device can then be lowered in the drilling column by the cable. As soon as the gripping device strikes the coupling cone 60 of the sealing piston 58, the coupling engages and piston 58 can be pulled out of the column.

The drill column 4 and device 6 are then lowered. In the process, the sloping surfaces 24*a* of bars 24 touch the inner edge of the top end face 38 of pipe 5 and are pressed inwards by the required amount against the force of springs 28. When further lowered, they slide along the inner surface of pipe 5. The process is complete when the surfaces 37 of the bearing members 34 rest on end face 38. Even if openings 39 in the top part of pipe 5 are not already aligned with bars 24, the bars 24 nevertheless engage the openings when the drill column is subsequently rotated. Springs 28 then drive bars 24 into the openings, so that both tensile and torsional forces can be transmitted from column 4 to pipe 5. The bearing members 34 ensure that bars 24 are at the right level for openings 39 when lowered. Members 34 can also exert downward pressure on pipe 5.

If the device is to be uncoupled from pipe 5, the sealing piston 58 is first lowered by a cable into column 4. As soon as it rests at the sealing position, the gripping device opens and can then be pulled up. In accordance with the previously-described operation, pump 61 then introduces pressure medium, thus operating the actuator 46 and moving the directional control valve 48. The pressure medium can thus flow via the pressurizing valve 63 to the directional-control valve connection 54 and into the control line 56, thus opening the non-return valve 55. As a result of the pressure drop after switching off the pump 61, the piston of actuator 46 is returned to its starting position by spring 46*a*. Line 50 is now connected to the outlet line 49, so that the pressure medium can flow out of the cylinder chambers 21, 31 of units 17, 18 and springs 23, 33 move pistons 20, 30 radially inwards into the inoperative position, so that bars 24 and bearing members 34 are both withdrawn from pipe 5. Device 6 is thus disconnected from pipe 5. By means of the cable and the gripping device, piston 58 can be withdrawn from column 4 so that the column is free and available for another drilling operation independently of pipe 5.

At any time, the drill column can be reconnected to pipe 5 by device 6, so as to carry out the individual processes in the manner already described.

Figure 5:
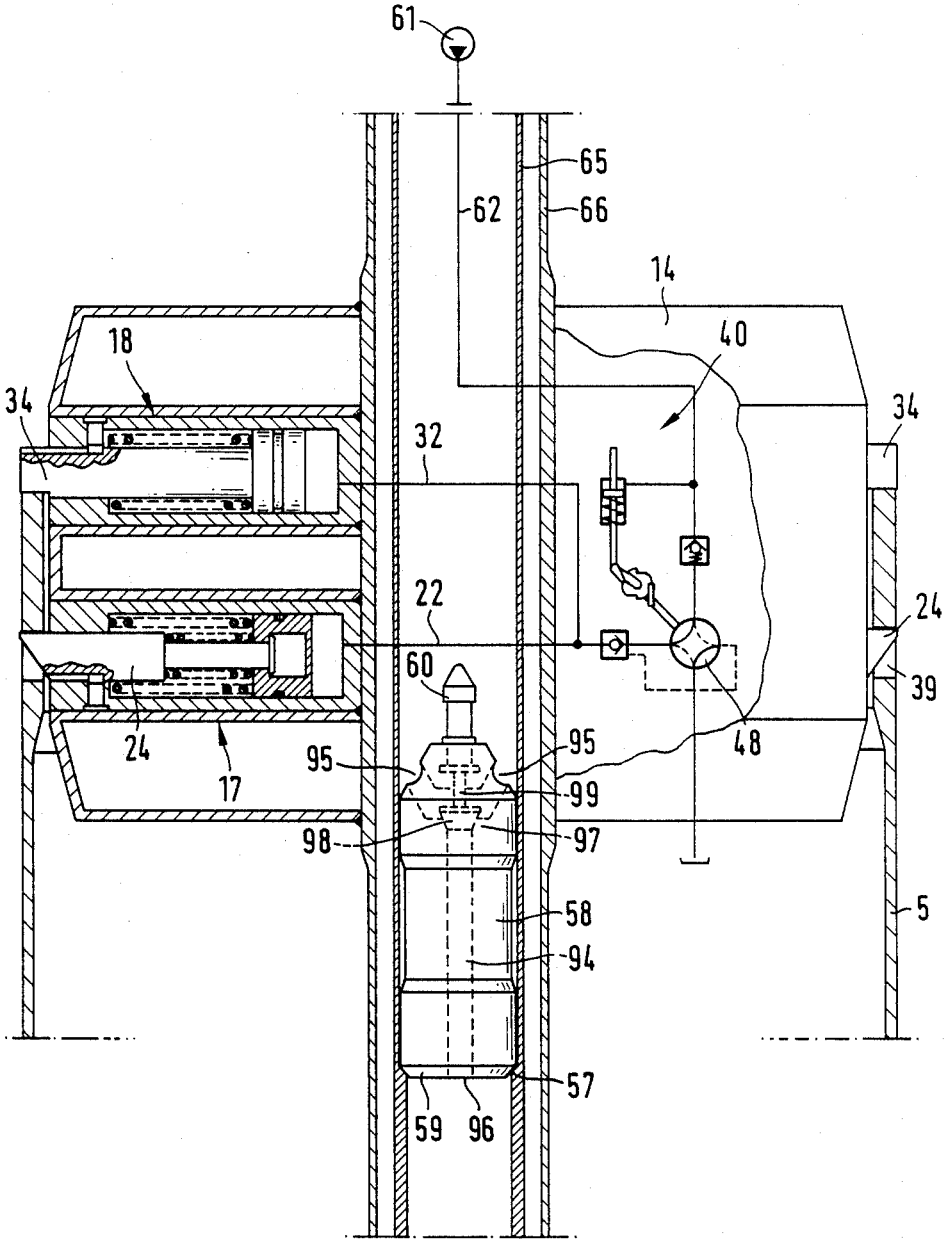
FIG. 5 is a view similar to FIG. 2 of a modified embodiment of the device.

FIG. 3 shows an embodiment of device 6 for incorporation in a "flange column", i.e. a drilling column with parts comprising external lines 64 (FIG. 3) e.g. for conveying air. By contrast, FIG. 5 shows a device for incorporation in a "double-wall" column and, like the column parts, comprising an inner pipe 65 surrounded by an outer pipe 66, to which the casing of the device is secured. In other respects the construction is similar to the embodiment in FIG. 3. Similar or corresponding parts in FIG. 5 are given the same reference numbers as in FIG. 3. The actuating system is shown in simplified form in FIG. 5.

Figure 6:
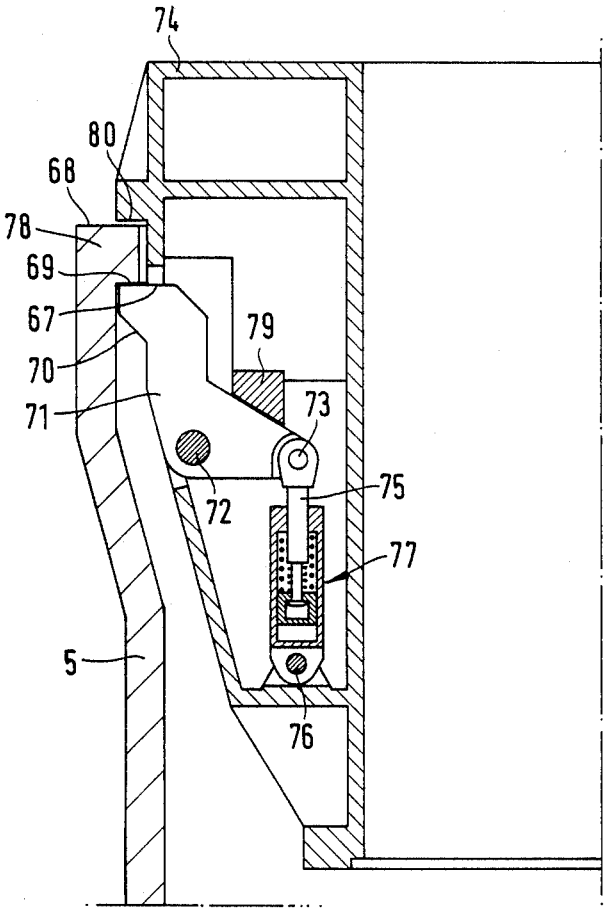
FIG. 6 is an enlarged cross-sectional view of another embodiment of a coupling member.

FIG. 6 shows another embodiment of a coupling member, which in the present case is a toggle lever 71 pivotable around a stationary shaft 72 in casing 74. The internal end of lever 71 is connected by a link pin 73 to the piston rod 75 of a piston-cylinder unit 77, the cylinder being pivoted by means of a spigot 76 on casing 74. The piston rod 75 and its prolongation are substantially comparable with bar 24 and shank 25 of unit 17 in FIG. 3, so that the remarks there apply here correspondingly.

The coupling member 71 can be a bar for engaging an opening in a pipe, or can be a bearing member. The latter is shown in FIG. 6. The toggle lever 71 has a bearing surface 67 which can abut a co-operating surface 69 at the underside of an inwardly projecting collar 78 on the pipe. This part of lever 71 also has a slope 70, so that when the device is lowered it can slide over the edge of collar 78 and give way inwardly. Reference 79 denotes an abutment for a surface on the other arm of lever 71, thus providing support.

Casing 74 has a co-operating surface 80 facing the end face 68 at the top end of pipe 5 and used for bearing the casing when pipe 5 is to be loaded in the downwards direction. Alternatively, an upward axial force can be exerted on pipe 5 by member 71 in the position shown in FIG. 6.

Figure 7:
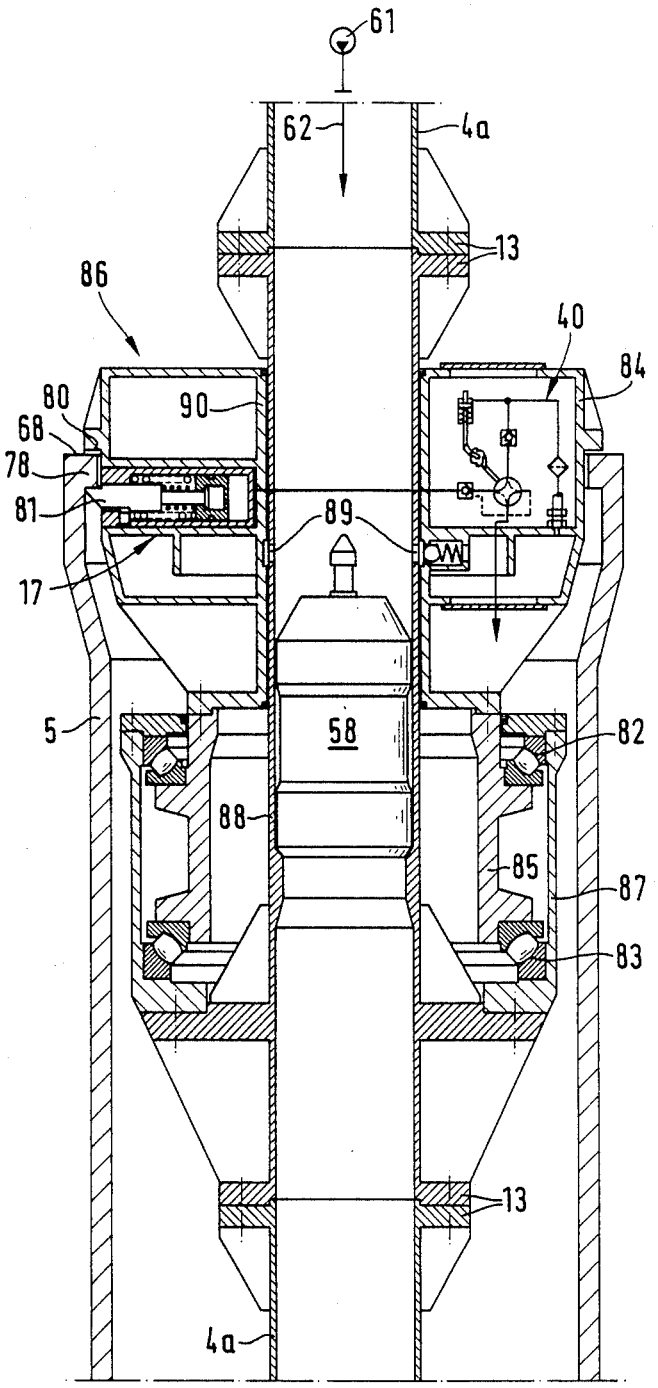
FIG. 7 is a view similar to FIG. 5 showing another embodiment of the device in longitudinal section.

FIG. 7 shows an embodiment of a device 86 for use when the drill column is to exert only an axial force on pipe 5 in one or the other direction, without transmitting a torque. In the last-mentioned embodiment, the top part of a casing 84 contains coupling members 81 sloping at the front end and an associated actuating system 40 as desoribed hereinbefore in conjunction with Figs. 3 and 4. The casing also has a co-operating surface 80 facing the end face 68 of pipe 5, as shown in FIG. 6 and described in connection therewith.

The casing has a projection 85 screwed to it at the bottom, on which an annular part 87 is rotatably mounted on rolling bearings 82, 83 and permanently connected to a tubular inner part 88 of the device. Part 88 forms the continuation of the drilling-column parts 4*a* and is connected to them by flanges 13. The inner part can thus rotate with the entire drill column relative to casing 84, i.e. relative to pipe 5.

Pressure medium is supplied to the actuating system 40 via the non-return valve 41 through a number of openings 89 in the inner part 88 and an annular channel in the cylindrical wall 90 of casing 84 surrounding the inner part.

As shown in FIG. 5, the sealing piston 58 advantageously has an inner passage 94 with one or more top inlet openings 95, a downward outlet opening 96 under the sealing surface 59, and a valve 97. The shank 99 of valve member 98 is connected to the coupling cone 60, which is axially movable over a certain distance, limited by an abutment. In the inoperative state, both parts are pressed downwards by a spring (not shown), thus closing valve 97. When, at the end of a process for coupling or uncoupling the drill column, piston 58 and pipe 5 have to be raised and the gripping device on the lowered cable has gripped the coupling cone 60, the tension in the cable at the beginning of the upwards motion initially moves the coupling cone 60 upwards together with valve member 98, so that the valve 97 is opened. Consequently, the amount of liquid, i.e. water, in the drill column above piston 58 can flow downwards through passage 94 and opening 96. A similar passage and valve can be present in all other embodiments of the device.

Figure 8:
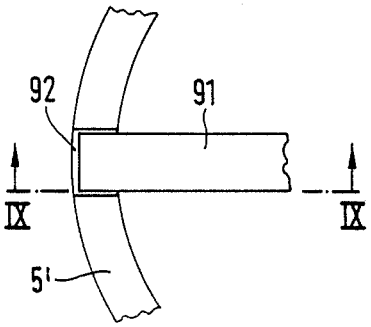
FIG. 8 is an enlarged detail view of another embodiment of the device with a tube in top view.
Figure 9:
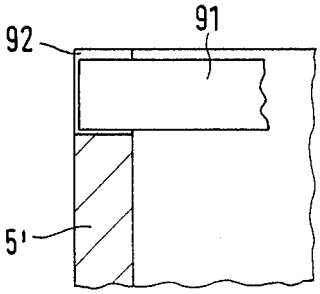
FIG. 9 is a cross-sectional view taken along line IX—IX in FIG. 8.

FIGS. 8 and 9 illustrate an embodiment in which the top edge region of the pipe 5' or coupling has a number of recesses 92, e.g. four, regularly distributed around the periphery. Coupling members 91 can engage in the recesses 92 and thus transmit a downward force and/or torque from the drill column to pipe 5'. In other repects the embodiment can be constructed as required. It can have other of the previously-described features, so that the previous remarks apply correspondingly here.

The invention can be operated in various ways, so that good account can be taken of numerous cases as required. It can be used for entraining a pipe in the axial direction and simultaneously rotating it; more particularly the bottom end of the pipe, which can bear a cutting rim or the like, will be approximately level with the drilling head at the bottom end of the column. In other cases the pipe can be entrained axially without rotation, e.g. when the pipe has to be lowered. Operation can then be as shown in FIG. 1. Pipe 5 is guided so that the drilling head 9 on the column goes beyond the bottom end of the pipe. The eccentric bit 9*a* is extended and a cavity is bored in the diameter of the pipe. At the end of a boring operation the eccentric bit 9*a* is retracted and the drilling head 9 is lowered to the bottom of the borehole, thus relieving the load. Pipe 5 can then be lowered in controlled manner by lowering the top part of the drill column by means of device 6, thus retracting the telescopic device 7. When pipe 5 has reached its end position, device 6 can be actuated for uncoupling pipe 5 from the drill column 4.

All features mentioned in the preceding description or shown in the drawings, insofar as permitted by the prior art, should be regarded as coming under the invention, either alone or in combinations.

I claim:

1. A device for incorporation in a drill column for releasably connecting the drill column to a pipe or similar hollow member comprising:

coupling members for attaching to the pipe;

piston-cylinder units operatively associated with said coupling members and having pistons adapted to be supplied at one end with a pressure medium for moving said pistons and coupling members to a coupling position and spring-loaded at the other end for resiliently urging said coupling members toward a non-coupling position; and an actuating system for operating said piston-cylinder units comprising, a pressure-medium source aboveground, a single pressure-medium line connected to said pressure-medium source, a directional control valve having an adjustable part and at least three connections, a pressure-medium supply line connected to said single pressure-medium line and a first correction of said connections, at least some of said cylinder-piston units being connected to a second connection of said connections, an outlet line connected to a third connection of said connections, a pressure-medium actuator connected to said pessure-medium supply line to be operated thereby, and a coupling means active in one direction operatively connected between said actuator and said adjustable part of said directional control valve.

2. A device as claimed in claim 1 wherein:

said actuator comprises a piston-cylinder unit with a piston return spring.

3. A device as claimed in claim 1 and further comprising:

a pressurizing valve in said pressure-medium supply line leading to said first connection of said directional control valve.

4. A device as claimed in claim 1 and further comprising:

a connecting line leading from said second connection of said directional control valve to said piston-cylinder units;

a non-return valve in said connecting line openable in the direction of said piston-cylinder units, a fourth connection on said directional control valve; and a control line connected between said non-return valve and said fourth connection.

5. A device as claimed in claim 1 wherein:

said pressure-medium line connected to said pressure-medium source comprises a central cavity in the drill column.

6. A device as claimed in claim 1 and further comprising:

a central cavity in the device; and a non-return valve operatively connected between said actuating system and said central cavity.

7. A device as claimed in claim 1 and further comprising:

a central cavity in the device;

a sealing piston lowerable by a cable into the drill column; and a seat in said central cavity engageable with said sealing piston.

8. A device as claimed in claim 7 and further comprising:

a passage in said sealing piston; and a value in said passage adapted to be actuated by a force transmitted by the cable.

9. A device as claimed in claim 1 wherein:

said coupling members comprise members for transmitting a downwardly directed force from the drill column to the pipe.

10. A device as claimed in claim 1 wherein:

said coupling members comprise members for transmitting an upwardly directed force from the drill column to the pipe.

11. A device as claimed in claim 1 wherein:

some of said coupling members are operatively associated with coupling-member-receiving holes in the pipe to be coupled.

12. A device as claimed in claim 1 and further comprising:

spring means between said coupling members and respective pistons for resiliently urging said coupling members relatively to said respective pistons of said piston-cylinder units, said coupling members being movable relative to said pistons;

a pipe-engaging outer end on each coupling member; and a sloping surface at said outer end.

13. A device as claimed in claim 1 wherein:

said coupling members comprise radial bars.

14. A device as claimed in claim 1 wherein:

said coupling members comprise toggle levers.

15. A device as claimed in claim 1 wherein:

said coupling members comprise bearing members each having a bearing surface adapted to be engageable against a surface on the pipe.

16. A device as claimed in claim 1 wherein:

said coupling members comprise movable bearing members; and further comprising a housing having at least one stationary surface facing a surface on the pipe.

17. A device as claimed in claim 1 wherein:

said coupling members comprise a plurality of bearing members and bars spaced apart in the axial direction of the device.

18. A device as claimed in claim 1 wherein:

recesses are provided in said top edge of the pipe; and said coupling members engage in said recesses for coupling with the pipe.

19. A device as claimed in claim 1 and further comprising:

a housing containing said coupling members; and an internal member rotatably mounted in said housing and connectable to parts of the drill column.

* * * * *